United States Patent [19]

Kahl

[11] Patent Number: 5,042,391

[45] Date of Patent: Aug. 27, 1991

[54] CABLE-GUIDED MESSENGER

[75] Inventor: Joel J. Kahl, El Cajon, Calif.

[73] Assignee: Kahl Scientific Instrument Corporation, El Cajon, Calif.

[21] Appl. No.: 493,485

[22] Filed: Mar. 14, 1990

[51] Int. Cl.[5] ..... B61B 7/00; E01B 25/16

[52] U.S. Cl. ..... 104/113; 105/151

[58] Field of Search ..... 104/112, 113, 114, 115, 104/173.1, 200, 208; 24/130; 114/102, 108, 243; 105/151

[56] References Cited

U.S. PATENT DOCUMENTS

| | | | |
|---|---|---|---|
| 2,267,469 | 12/1941 | Joys | 114/108 |
| 3,114,334 | 12/1963 | Kahl | 104/113 |
| 3,756,160 | 9/1973 | Kahl | 104/113 |
| 3,769,928 | 11/1973 | Kahl | 114/221 R |

FOREIGN PATENT DOCUMENTS

| | | | |
|---|---|---|---|
| 1297772 | 11/1970 | United Kingdom | 104/113 |

*Primary Examiner*—Douglas C. Butler
*Assistant Examiner*—S. Joseph Morano
*Attorney, Agent, or Firm*—Michael J. Striker

[57] ABSTRACT

A cable-guided messenger comprises a solid, one-piece, integral member having a substantially cylindrical shape and an axis, the member having an axially extending throughgoing opening, a transverse slot extending transversely to the axis and communicating with the opening, and two longitudinal slots extending substantially parallel to the axis and communicating with the transverse slot and the opening, so that a messenger can be fitted on a cable by inserting the cable into the transverse slot of the member and then turning the member so that the cable passes through the longitudinal slots and then into the opening.

14 Claims, 2 Drawing Sheets

CABLE-GUIDED MESSENGER

BACKGROUND OF THE INVENTION

The present invention relates generally to a messenger. More particularly, it relates to a cable-guided messenger, in particular adapted to move along a cable in order to operate instrumentalities located beneath the surface of the sea.

Cable-guided messengers of the above mentioned general type are known in the art. Some of such messengers are disclosed in U.S. Pat. Nos. 3,114,334, 3,756,160 and 3,769,928. There are also other constructions of messengers on the market. The purpose of the messengers is to be releasably locked to a cable extending, for instance, to an instrument located beneath the surface of the sea or other body of water. When it is desired to trip or otherwise act upon the instrument, the messenger is locked onto the cable and allowed to move down into the body of water along the cable under the influence of gravity. On reaching the instrument to which the cable extends, the weight of the messenger then acts upon the instrument in a suitable manner, for instance by tripping an operating lever or the like.

The known messengers are composed of several parts assembled with one another. Such a construction possesses certain disadvantages. The parts can disengage from a cable, break, become misaligned or distorted. The manufacture of the multi-part messengers is relatively expensive and their assembly is relatively complicated. The messengers require locking elements and other devices for preventing their falling off the cable. Their attachment to the cable and removal from the cable is rather slow and complicated.

SUMMARY OF THE INVENTION

Accordingly, it is an object of the present invention to provide a messenger of the above mentioned general type which avoids the disadvantages of the prior art.

More particularly, it is an object of the present invention to provide a messenger which is more reliable in operation, is easy and inexpensive to manufacture, and is easy and simple to attach to a cable and remove from the cable.

Another object is to have a device with a size and shape that permits usage with a gloved hand, when working in harsh polar or equatorial conditions and thermal-protection is required for workers, as well as an object that can be quickly and easily be brought into contact with and placed over a cable, in a positive manner, under adverse working conditions.

A further object is to provide a messenger of one-piece construction, not having any moving members or requiring any spare parts, and which provides life-time service without the need for maintenance.

In keeping with these objects and with others which, will become apparent hereinafter, one feature of the present invention resides, briefly stated, in a messenger which is formed as a solid, substantially cylindrical, one-piece member having a central throughgoing axial opening, a transverse slot extending transversely to the axis and communicating with the central opening, and two longitudinal slots located opposite to one another and communicating both with the transverse slot and the central opening, so that a cable can first be introduced into the body through the transverse slot and then the body can be turned so that the cable then passes through the longitudinal slots and assumes a position inside the central opening.

When the messenger is formed, in accordance with the present invention, as a one-piece solid member having the transverse slot and two longitudinal slots communicating with the central throughgoing opening, it has no moving parts which can loosen, wear, break, deform, become misaligned, distorted, etc. It is maintenance free and can be used continuously without damage. It is easy and inexpensive to manufacture, for example by cutting the slots and the opening in a cylindrical bar, by molding the single-piece member, etc. It is very easy and simple to attach to a cable, by placing its cylindrical body horizontally against the cable and simply sliding it until its transverse slots slips over the cable, for a positive engagement, which is of great advantage during heavy seas, rough weather or working under lighting conditions causing poor visibility. It fits in the hand of a user, even when gloved due to inclement conditions, during attachment and removal, and therefore accidental loss at sea is greatly reduced. It is very simple to remove from the cable. The messenger does not have any accessory parts, such as hinges, springs, locking pins, closing devices, etc, for preventing its falling off the cable, which simplifies its manufacture, maintenance and handling; it cannot fall off or accidentally be released from the cable as it must be removed manually and no service or maintenance is ever required.

The new messenger, in accordance with the present invention, is reliable in operation since no springs, components or connecting parts can loose their elasticity, weaken or deteriorate during use. No moving parts are provided, which can fall or corrode due to dissimilarity of metals used. No moving parts can seize or malfunction due to build up of chemicals or sea-water particles when stored or not properly maintained.

The novel features which are considered as characteristic for the invention are set forth in particular in the appended claims. The invention itself, however, both as to its construction and its method of operation, together with additional objects and advantages thereof, will be best understood from the following description of specific embodiments when read in connection with the accompanying drawings.

BRIEF DESCRIPTION OF THE DRAWINGS

FIG. 2 is a view illustrating a process of attaching the messenger in accordance with the present invention to a cable, a wire and the like;

DESCRIPTION OF THE PREFERRED EMBODIMENTS

Figure 1:
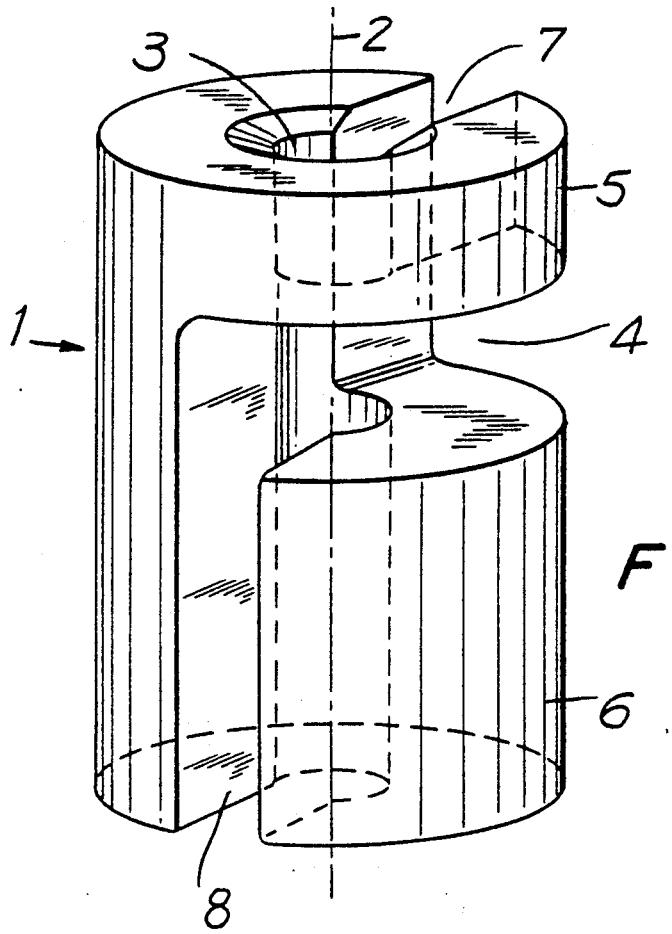
FIG. 1 is a perspective view of a messenger in accordance with the present invention.

A cable-guided messenger, in accordance with the present invention, is formed as a one-piece integral solid member which is identified as a whole, with reference numerals. The member 1 has a cylindrical configuration, preferably in the shape of a circular cylinder as shown in FIG. 1. In the embodiment shown here, the member 1 is a rotation-symmetrical member relative to its axis 2.

The member 1 is provided with an opening 3, which in the shown embodiment, is located centrally of the member 1, extends along its longitudinal axis 2, and is open at both axial ends. The central opening 3 can be formed as a cylindrical opening.

The member 1 is further provided with several slots which will be described in detail later on. One of the slots is identified with reference numeral 4. The slot 4 extends transversely to the longitudinal axis 2 of the member 1 and is preferably somewhat offset upwardly. Thereby the member 1 is subdivided by the slot 4 into an upper shorter part 5 and a lower longer part 6.

The member 1 is further provided with two longitudinal slots. One of the longitudinal slots is formed in the upper part 5 of the member 1 at one radial side of the axis 2. The short slot 7 extends in the axial direction of the member 1 and communicates both with the central opening 3 and with the transverse slot 4. The other of the longitudinal slots 8 is formed in the lower part 6 of the member 1 and located at an opposite radial side of the axis 2. The slot 8 extends in the axial direction of the member 1 and communicates both with the central opening 3 and with the transverse slot 4. Necessarily, the longitudinal slots 7 and 8 are offset by 180° relative to one another in a peripheral direction of the member 1. They have a width which is smaller than the diameter of the central opening 3. The transverse slot 4 has a width which is greater than the width of the longitudinal slots 7 and 8, and it cuts through the member 1 over an arc which preferably does not exceed 180°.

Figure 2:
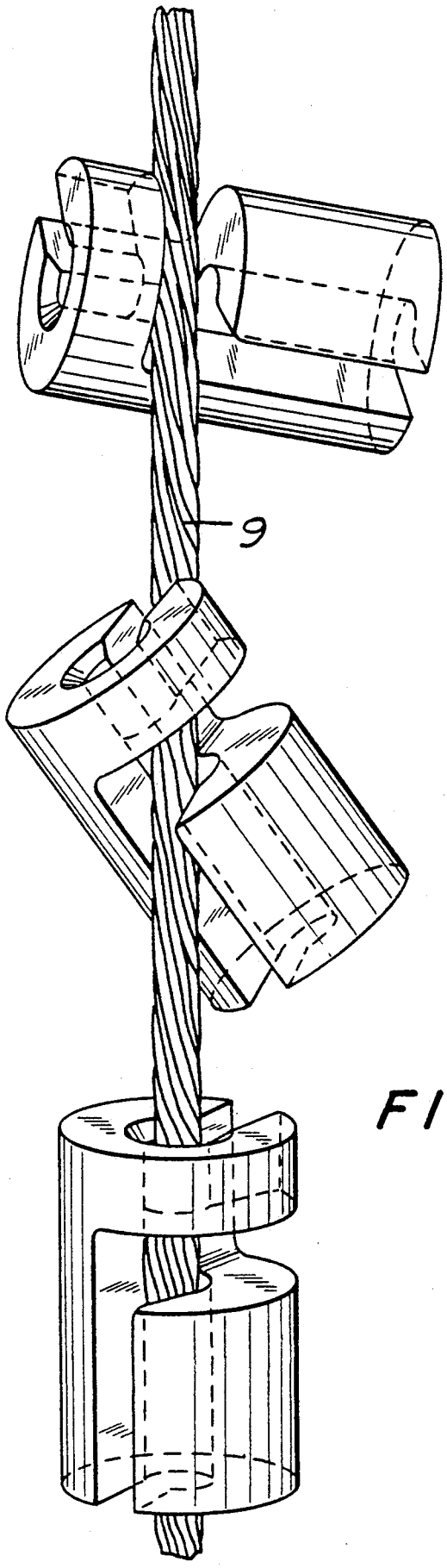

The messenger of the present invention is attached to a cable and the like in an exceptionally simple manner. The user holds the messenger in a horizontal position shown in the top drawing of FIG. 2 and fits the messenger with its transverse slot 4 onto the cable 9, which is very easy to do. Then the messenger is turned so as to bring the longitudinal slots 7 and 8 in alignment with the cable 9 and then to pass the cable 9 through the slots into the central opening 3, as shown in the central drawing and the bottom drawing of FIG. 2. The messenger becomes securely attached to the cable and is guided on the cable downwardly for activating respective devices under the water surface when needed. The detachment of the messenger from the cable is performed in a reverse order in the same simple manner.

Figure 3:
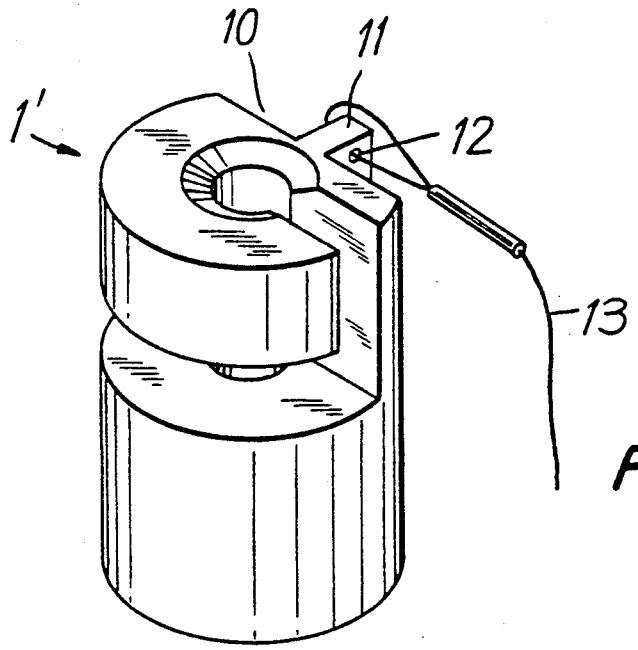
FIG. 3 is a view showing a further modification of the messenger in accordance with the present invention.

FIG. 3 shows a further embodiment of the invention. In this Figure the messenger has also a substantially cylindrical member 1' which, however, is flattened on its one surface 10. In the region of the flattening, or more particularly on the flattened wall 10, a projection 11 with a hole 12 is provided for a lanyard 13. The lanyard serves for hanging on a hook when the messenger is not in use. Also, the lanyard serves to suspend the messengers from instruments, when the equipment is to be operated in series, such as water bottles lowered into the ocean to trap samples of sea water. In such operation, the messenger below is twisted onto the wire and the lanyard is attached to the bottle release. This is done as each bottle is attached to the wire and lowered into the sea. When all bottles are at the predetermined depth, the first messenger is manually dropped down the line to impact the bottle-release below. Automatically, its suspended messenger is released to impact the bottle-release below, and so on.

The member 1, 1' of the messenger can be provided with a coating, for example composed of epoxy resin or tetrafluoroethylene. The coating is especially provided when non-contaminating material contact is required. Since the member 1, 1' is a one-piece member, such coatings have a long service life. In contrast, in known messengers with movable parts, the coatings can wear off, flake or peel, which can also impede their operation. Also, the heating processes necessary for some coatings cause distortions of small metal parts, which would adversely affect the assembly and use of other messengers.

It should be emphasized that some dimensions selected in the member 1 are of special importance. The transverse slot 4 is wider than the longitudinal slots 7 and 8 and the central opening 3 so as to facilitate the introduction of the cable through the slot 4 in rough or adverse conditions. The width of the slots 7 and 8 is smaller than the diameter of the central opening 3 so that when the cable is received in the central opening 3, it is retained there by shoulders formed by the remaining unslotted portions. The slot 4 is offset upwardly so that the part 5 of the member 1 is shorter, while the part 6 of the member 1 is longer. In this construction the center of gravity of the messenger is favorably located in the lower part 6 to impart stability to the messenger. In addition, as can be seen from FIG. 1, the center opening 3 is provided with a champfer at its one axial end or at its both axial ends. The champfer eliminates the sharp edges which otherwise can be deformed and bent inwards. In this case they would scrape against the wire and thereby slow its sliding movement and damage the wire. It will be understood that each of the elements described above, or two or more together, may also find a useful application in other types of constructions differing from the types described above.

An additional feature is that the hand-held messenger can be line attached, using either left- or right-hand. Other messengers give difficulty for left hand use due to design. The messenger in accordance with the present invention is easily pressed against the wire, from the front side, twisted upright and allowed to free-fall down the line with right-hand operation. When used with the left hand, the wide slot is pressed against the wire, from the back side. In both instances, there is positive attachment, either pushed against the wire or pulled against the wire, before twisting upright and released. There is no chance of accidental loss, due to insecure or incorrect placement on the wire.

Ease of attachment, because of the wide, short horizontal slot, is an important consideration when working under poor daylight conditions, as well as during nighttime operations, as the lowering wire is not clearly visible. Besides the difficulty and/or inconvenience when using other messengers, messengers are lost at sea due to failure to correctly attach them to the wire.

The longitudinal slots and smooth-walled, cylindrical shape of the inventive messenger reduce vibration or "fluttering" as it drops down the line. The non-fluttering messenger minimizes wear on the line, particularly in oceanic sampling, as the equipment can be lowered to many hundreds of meters below the surface; it also increases the rate of fall, which provides time and cost savings in use. This feature is not found in any other messengers.

While the invention has been illustrated and described as embodied in a cable-guided messenger, it is not intended to be limited to the details shown, since various modifications and structural changes may be made without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention.

What is claimed as new and desired to be protected by Letters Patent is set forth in the appended claims.

I claim:

1. A cable-guided messenger, comprising a solid one-piece integral member having a substantially circular cylindrical shape and an axis and being attachable to and freely movable under the action of gravity along a cable to actuate an object, by the weight of said member upon its free movement and impact against the object, said member having an axially extending throughgoing opening, a transverse slot extending transversely to said axis and communicating with said opening, and two longitudinal slots extending substantially parallel to said axis and communicating with said transverse slot and said opening, so that the messenger can be fitted on the cable by inserting the cable into the transverse slot of said member and then turning said member so that the cable passes through said longitudinal slots and then into said opening.

2. A messenger as defined in claim 1, wherein said opening is located substantially centrally of said member and coaxial relative to said axis.

3. A messenger as defined in claim 1, wherein said member has two axial ends, said transverse slot being offset toward one of said axial ends so as to form in said member a portion with a shorter axial size and a portion with a longer axial size so that the center of gravity of the messenger is located in said portion with a longer axial size to impart stability to the messenger.

4. A messenger as defined in claim 3, wherein a substantial portion of said member is formed to act as a cable-guide.

5. A messenger as defined in claim 1, wherein said opening has two axial ends, at least one of said axial ends of said opening being provided with a champfer.

6. A messenger as defined in claim 1, wherein said member has an outer circular cylindrical surface which is concentric to said axis, said opening of said member being circular cylindrical and concentric to said axis and to said outer circular cylindrical surface.

7. A messenger as defined in claim 1, wherein said longitudinal slots are located opposite to one another at opposite sides of said axis.

8. A messenger as defined in claim 7, wherein said longitudinal slots of said member are offset relative to one another by 180° in a peripheral direction of said member.

9. A messenger as defined in claim 1; and further comprising a coating which coats the surface of said member.

10. A messenger as defined in claim 1; and further comprising means for connecting said member to a holding element and including a connecting part attached to said member.

11. A messenger as defined in claim 10, wherein said member has a flattened surface, said connecting part being arranged on said flattened surface.

12. A messenger as defined in claim 11, wherein said connecting part is formed as a projection with a hole.

13. A cable-guided messenger, comprising a solid one-piece integral member having a substantially cylindrical shape and an axis, said member having an axially extending throughgoing opening, a transverse slot extending transversely to said axis and communicating with said opening, and two longitudinal slots extending substantially parallel to said axis and communicating with said transverse slot and said opening, so that the messenger can be fitted on the cable by inserting the cable into the transverse slot of said member and then turning said member so that the cable passes through said longitudinal slots and then into said opening, said opening having a predetermined diameter, said transverse slot having a width which exceeds said diameter.

14. A cable-guided messenger, comprising a solid one-piece integral member having a substantially cylindrical shape and an axis, said member having an axially extending throughgoing opening, a transverse slot extending transversely to said axis and communicating with said opening, and two longitudinal slots extending substantially parallel to said axis and communicating with said transverse slot and said opening, so that the messenger can be fitted on a cable by inserting the cable into the transverse slot of said member and then turning said member so that the cable passes through said longitudinal slots and then into said opening, said longitudinal slots having a predetermined width, said transverse slot having a width which exceeds the width of said longitudinal slots.

* * * * *